US005712672A

United States Patent [19]

Gooray et al.

[11] Patent Number: 5,712,672

[45] Date of Patent: Jan. 27, 1998

[54] RECORDING SHEET TRANSPORT AND EFFLUENTS REMOVAL SYSTEM

[75] Inventors: Arthur M. Gooray; Kenneth C. Peter, both of Penfield, N.Y.

[73] Assignee: Xerox Corporation, Stamford, Conn.

[21] Appl. No.: 415,284

[22] Filed: Apr. 3, 1995

[51] Int. Cl.[6] ..... B41J 2/01

[52] U.S. Cl. ..... 347/102; 34/259; 219/691; 219/738; 219/745

[58] Field of Search ..... 347/102.1, 104, 347/28; 34/259, 260, 265; 355/285, 295; 219/216, 686, 700, 701, 738, 745, 646, 691; 141/65; 248/362; 414/217

[56] References Cited

U.S. PATENT DOCUMENTS

| | | | |
|---|---|---|---|
| 3,739,130 | 6/1973 | White | 219/10.55 |
| 4,216,591 | 8/1980 | Bubley | 34/18 |
| 4,469,026 | 9/1984 | Irwin | 101/426 |
| 5,124,728 | 6/1992 | Denda | 346/134 |
| 5,349,905 | 9/1994 | Taylor et al. | 101/488 |
| 5,392,107 | 2/1995 | Paxon et al. | 355/312 |
| 5,422,463 | 6/1995 | Gooray et al. | 219/694 |

*Primary Examiner*—Benjamin R. Fuller
*Assistant Examiner*—Juanita Stephens
*Attorney, Agent, or Firm*—Daniel J. Krieger

[57] ABSTRACT

A transport system for transporting a recording sheet having liquid ink deposited thereon through a dryer for drying the liquid ink having an input portion and an output portion. The transport system includes a transport belt disposed between the input portion and the output portion for transporting the recording sheet through the dryer. A negative pressure member is located beneath the belt and defines a negative pressure chamber. The pressure member decreases the pressure within the pressure member so that a non-uniform negative pressure is applied to the recording sheet during transport through the dryer. A directing member located within a plenum directs differing negative pressures within the plenum such that negative pressures decrease in amplitude along the transport direction. The application of a negative pressure within the plenum also tends to reduce or remove evaporated liquid driven from the inks during drying. This removal of evaporated liquid prevents or reduces the occurrence of a phenomenon known as "dryer rain". Dryer rain results from the accumulation of evaporated liquids within the dryer which eventually condenses sufficiently to fall within the dryer back onto the recorded sheet.

16 Claims, 5 Drawing Sheets

RECORDING SHEET TRANSPORT AND EFFLUENTS REMOVAL SYSTEM

FIELD OF THE INVENTION

This invention relates generally to a liquid ink printer and more particularly to a recording sheet transport and effluents removal system in an ink jet printer.

BACKGROUND OF THE INVENTION

An ink jet printer of the type frequently referred to as drop-on-demand, has at least one printhead from which droplets of ink are directed towards a recording medium or recording sheet. Within the printhead, the ink is contained in a plurality of channels. Piezoelectric devices or power pulses cause the droplets of ink to be expelled as required, from orifices or nozzles located at the end of the channels. In thermal ink-jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse, the ink within the channel retracts and then separates from the bulging ink to form a droplet moving in a direction away from the nozzle and towards the recording medium. The ink, at impact with the recording medium, forms a spot. The channel is then refilled by capillary action which, in turn, draws ink from a supply container of liquid ink. Operation of a thermal ink jet printer is described in, for example, U.S. Pat. No. 4,849,774.

The ink jet printhead may be incorporated into either a carriage type printer, a page width type printer, or a combination of the two. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium such as paper or a transparency. After the swath is printed, the paper is stepped a distance equal to the height of the printed swath, or a portion thereof, so that the next printed swath is overlapping or contiguous therewith. The procedure is repeated until the entire page is printed. In contrast, the page width printer includes a stationary printhead having a length sufficiently long to print across the width or length of the recording medium. The recording medium is continually moved past the page width printhead in a direction normal to the length of the printhead and at a constant or varying speed during the printing process. A page width ink jet printer is described in U.S. Pat. No. 5,192,959.

Many liquid inks and particularly those used in thermal ink jet printing include a colorant and a liquid which is typically an aqueous liquid vehicle. Some thermal ink jet inks also include a low vapor pressure solvent. When a recording medium is printed with ink jet ink, the individual spots of ink deposited on the substrate form an image in the form of text and/or graphics. Once deposited, the liquid is removed from the ink and paper to fix the ink to the substrate.

Liquid can be removed from the ink and the printed recording medium by a number of methods. One simple method is natural air drying in which the liquid component of the ink deposited on the recording medium is allowed to evaporate without mechanical assistance resulting in natural drying. Another method is to transport the printed recording medium through a dryer to evaporate the liquid.

Active drying applies heat to the liquid ink which has been deposited on the printing medium for removing the liquid therefrom to fix the ink to the recording medium. For instance, if a sheet is covered with 10% printing, as in text only printing, the amount of liquid to be removed is quite small. If the sheet is covered with 90% printing, however, as when a graphic image is printed, the amount of liquid to be removed is substantially more. Active drying includes the application of heat energy with infrared lamps and microwave energy applicators. In each of these cases, it is essential to reliably transport the liquid laden recording medium reliably through the applicator. In addition, it also important to reliably remove the evaporated liquid which can collect in the dryer. If enough of the evaporated liquid remains in the dryer and condenses therein, a phenomenon known as "dryer rain" occurs in which the condensed liquid begins to fall back onto the previously printed recording medium which can damage the image printed thereon. Consequently, a transport mechanism for transporting liquid laden recording sheets through an active dryer must reliably transport the recording medium through the dryer and also remove any evaporating liquids or solvents to prevent or reduce the effects of the "dryer rain" phenomenon.

Various apparatus for drying recording mediums printed with liquid ink are illustrated and described in the following disclosures which may be relevant to certain aspects of the present invention.

In U.S. Pat. No. 3,739,130 to White, a multicavity applicator is described for treating a moving web of material across the width with microwave energy. Means are provided for directing the flow of air or another desired gas through the material web passageway of the applicator for removal of vapor evolved from the sheet of material being treated.

U.S. Pat. No. 4,469,026 to Irwin, describes a method and apparatus for controlling drying and the detaching of printed material. A plurality of conveying belts transport sheet material past a dryer.

U.S. Pat. No. 5,124,728 to Denda, describes an ink jet recording apparatus having a vacuum platen. A flat section of the platen includes a plurality of opening holes through which a vacuum device creates a vacuum to attract a recording medium onto the flat section of the platen. The dimensions for the density of the opening holes is gradually reduced so as to compensate for differences in width of the recording medium to thereby effectively avoid the floating of a medium.

U.S. Pat. No. 5,349,905 to Taylor et al. describes a method and apparatus for controlling peak power requirements of a printer. The speed of the sheet transport system is controlled in accordance with the image density. The recording medium is transported through the printer by a belt and a vacuum arrangement associated with the belt to hold the sheets thereto. The belt carries the sheets through a microwave dryer for drying the liquid ink deposited on the recording medium.

U.S. patent application Ser. No. 08/159,908 having the title "Apparatus and Method for Drying Ink Deposited by Ink Jet Printing," assigned to Xerox Corporation, describes a microwave dryer for drying the liquid ink deposited on a recording medium by an ink jet printer. A belt or belts carry the recording medium through the microwave dryer for drying. A transport mechanism, such as one using a vacuum applied to the bottom side of the paper or one using a static mat, transports the paper through the microwave dryer.

U.S. patent application entitled "Liquid Ink Printer Vacuum Transport System" to Teumer et al., Ser. No. 08/353,862, assigned to Xerox Corporation, describes a liquid ink printer having a vacuum transport system for transporting recording sheets through drop-on-demand or continuous stream type printers. A belt having a plurality of apertures defined therein transports a recorded sheet through a microwave dryer. A vacuum member holds the recorded sheet to the belt during transport through the microwave dryer.

SUMMARY OF THE INVENTION

In accordance with one aspect of the present invention, there is provided an ink jet printer of the type in which liquid ink is deposited on a recording medium. The ink jet printer includes a dryer for evaporating liquid from the liquid ink deposited on the recording medium, a transport belt associated with the dryer for moving the recording sheet through the dryer, and an evacuation device operatively coupled to the dryer removing the evaporated liquid in the dryer.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
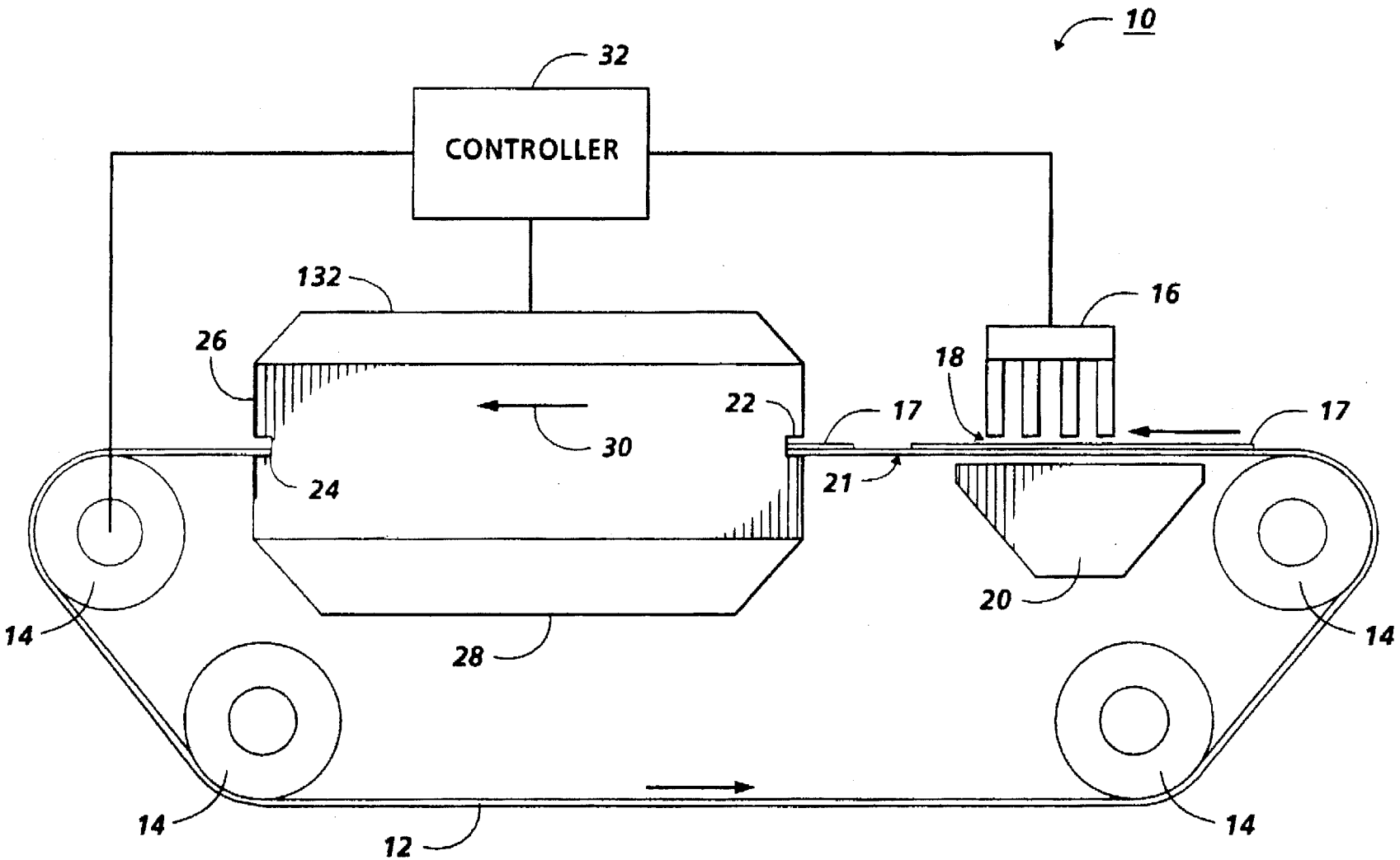
FIG. 1 is a schematic side elevational view of one embodiment of an ink jet printer incorporating the present invention.

FIG. 1 illustrates a schematic side view of an ink-jet printer 10. The ink-jet printer 10 includes an input tray (not shown) containing cut sheets of a recording medium, such as paper stock or transparencies, to be printed on by the ink-jet printer. Individual recording sheets are removed from the input tray and fed onto a transport belt 12 driven by rollers 14 beneath a printing member 16. The transport belt 12 is substantially transparent to microwave energy and includes a plurality of holes through which a vacuum is applied to hold the printing sheet to the belt as it moves through the printer. Suitable materials include materials having low loss, high dielectric properties, such as ULTEM, a polyetherimide, available from General Electric, KALADEX, a polyethylene napthalate, Melinex, a polyester film, both available from Imperial Chemical Industries (ICI) of Wilmington, Del., and other materials substantially transparent to microwave energy that can be formed into a belt. The transport belt can also include a plurality of belts separated by a distance and each driven by respective rollers.

The printing member 16 includes one or more page width ink-jet printheads which deposit liquid ink on the sheet of paper or transparency or other printing media as the belt 12 carries the recording sheet past the printing member 16. As illustrated, the printing member 16 includes four page-width printbars for printing full color images comprised of the colors cyan, magenta, yellow, and black. Each of the page-width ink-jet printbars includes a linear array of print nozzles so that ink is deposited across the sheet. The present invention is equally applicable, however, to printers having an ink-jet printhead which moves across the sheet periodically in swaths, to form the image, to printers having staggered arrays of printheads or to printers having a single printbar. The print member 16 includes an ink supply which may either be located with the printhead itself or may be located elsewhere and connected to the printhead through an ink conduit. In addition to an ink supply, the print member 16 includes the necessary electronics to control the deposition of ink on the individual sheets.

During printing, a recording sheet 17 is held to the transport belt 12 through a printing zone 18, by an applied vacuum from a first vacuum applicator 20. An interdocument region 21 is located between recording sheets 17 in areas where the transport belt 12 is not in contact with the recording sheets 17. Once printed, the printed recording sheet 17 enters an input portion or slot 22 and exits an output portion or slot 24 of a dryer 26. The dryer 26 has attached thereto an airflow evacuation device 28 or a second vacuum applicator for further application of a vacuum to the recording sheet 17 through the belt or belts 12 during travel from the printing zone 18 and through the dryer 26 in the process direction of an arrow 30 and for removal of effluents, such as evaporated liquids or solvents, from the dryer which are driven from the ink by drying. The transport belt enables the use of a single transport for both imaging and drying. It is also possible that a single vacuum applicator could be used in both the imaging region and the dryer 26. Once the recording sheet 17 has been dried by the dryer 26, it exits the output slot 24 and is deposited in an output tray (not shown).

A controller 32 controls the printing member 16, the dryer 26, and the rollers 14, as would be understood by one skilled in the art. In addition, an adaptive dryer control for controlling the speed of the belt 12 through the dryer 26 can also be used. U.S. Pat. No. 5,214,442 entitled "Adaptive Dryer Control for Ink-Jet Processors", assigned to Xerox Corporation, discloses such an adaptive dryer control and is hereby incorporated by reference.

In the present embodiment of the invention, the dryer 26 includes a microwave dryer applying microwave power to dry the ink deposited on the recording sheet 17. A microwave dryer suitable for use in the present invention is described in U.S. patent application Ser. No. 08/159,358 entitled "Dummy Load for a Microwave Dryer" assigned to Xerox Corporation and filed Nov. 30, 1993, the relevant portions of which are incorporated herein by reference. Since a microwave dryer is being used, inks specially formulated to absorb microwave power are preferred. Such inks may include compounds designed to couple with the microwave power for increasing the amount of heat conducted thereby. One such compound is an ionic compound, at least ionizable in the liquid vehicle. U.S. Pat. No. 5,220,346 entitled "Printing Processes with Microwave Drying" assigned to Xerox Corporation, discloses a suitable ink and is hereby incorporated in this application by reference.

While ink-jet printing with page-width printheads provides for higher speeds of printing when compared to scanning carriage type of ink-jet printheads, it has been found that transporting printing sheets accurately and consistently past the page-width printhead 16 and through the microwave dryer 26 requires special considerations. Consequently, the present invention as described herein, provides a solution for the problems associated with transporting the recording sheets 17 past page-width thermal ink-jet printbars and through an active dryer.

Figure 2:
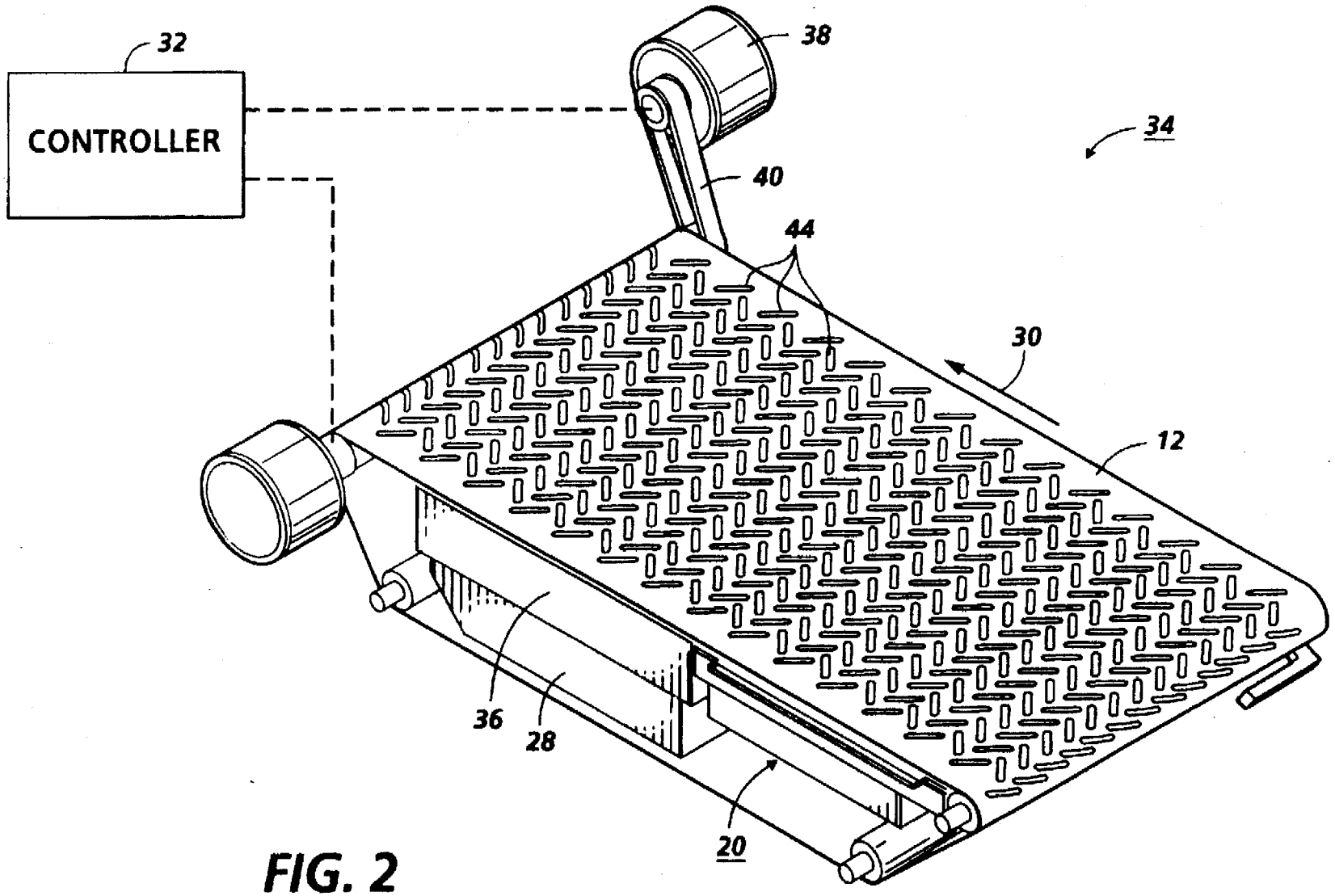
FIG. 2 is a schematic perspective view of one embodiment of a vacuum transport device including a vacuum transport belt system.

FIG. 2 illustrates an ink-jet vacuum transport system 34. The vacuum transport system 34 includes the belt 12, the first vacuum applicator 20, and the evacuation device 28. A bottom half 36 of the microwave dryer 26 is also shown. A motor 38 is connected to one of the rollers 14 through a pulley 40 to thereby move the transport belt 12 in the process direction 30. The belt 12 includes a plurality of apertures arranged in a pattern to enable the first vacuum applicator 20 and the evacuation device 28 to apply vacuum holddown for the recording sheet 17 as it moves along the process direction 30 beneath the printheads 16, through the printzone 18, and through the dryer 26. Suitable apertures for the belt 12 are described in the previously referred to U.S. patent application entitled "Liquid Ink Printer Vacuum Transport System" to Teumer et al., the relevant portions of which are incorporated by reference. The second vacuum applicator 28 applies a vacuum through the bottom half 36 of the dryer 26 which includes a plurality of apertures therein to enable the vacuum to pass through the apertures 44 to the sheet 17. Suitable apertures for the bottom half 36 of the dryer 26 are illustrated in FIG. 7 of the previously incorporated by reference U.S. patent application Ser. No. 08/159,358. The apertures are sized to impede microwave leakage from the dryer.

Figure 3:
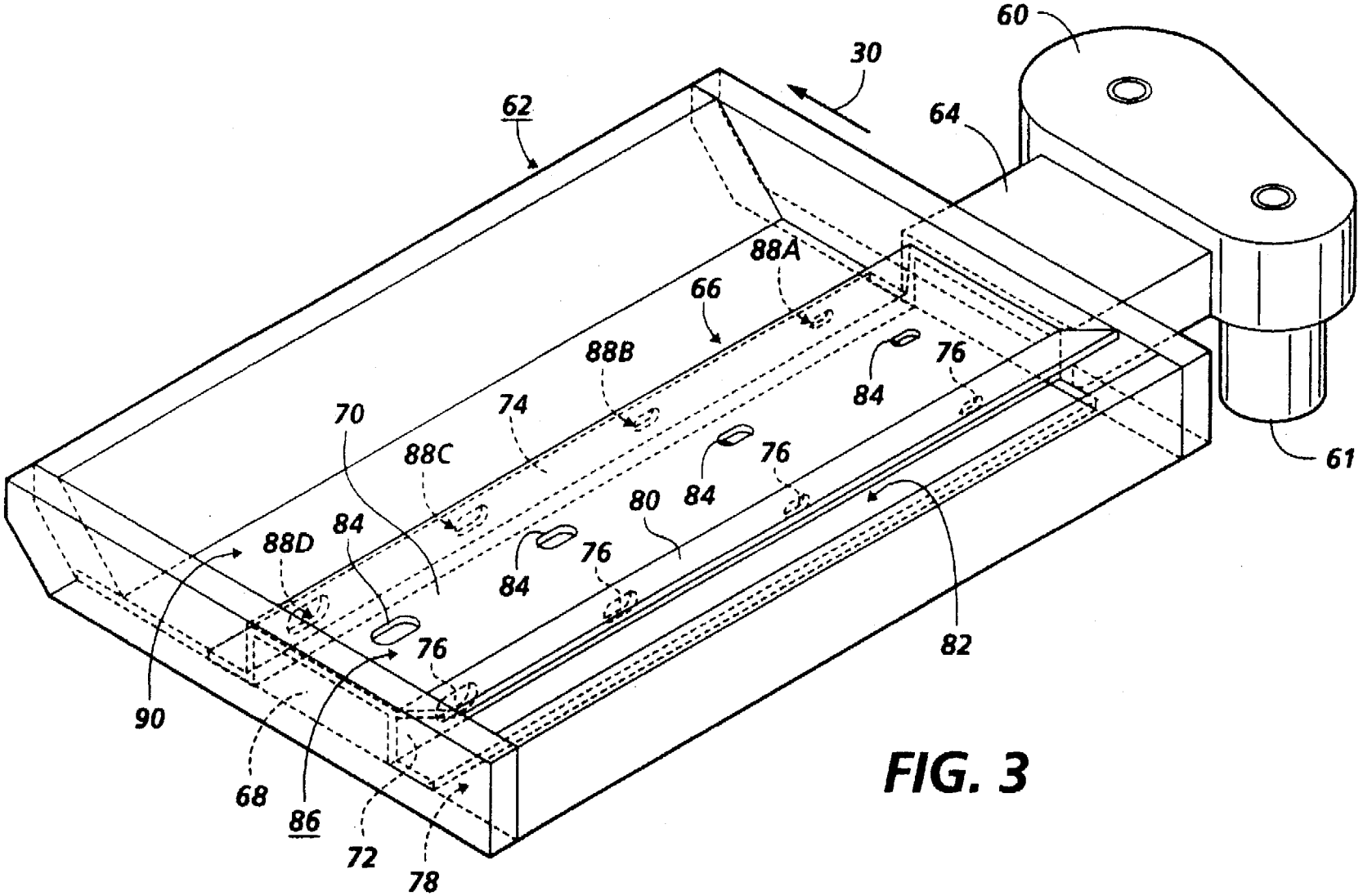
FIG. 3 is a perspective view of one embodiment of a pressure member defining a negative pressure chamber for directing a vacuum to a transport belt for holding a recording sheet thereto.

FIG. 3 illustrates the evacuation device 28 which applies the necessary vacuum for holding the recording sheet 17 to the belt 12 when traversing from the input slot 22 through the microwave dryer 26 and exiting the output slot 24. The evacuation device 28 includes a negative pressure generator 60 having an exhaust member 61 attached to a vacuum plenum 62 by a connecting member 64. The generating member 60 generates a negative air flow and a vacuum which creates a negative pressure within the plenum 62 of greater than one-quarter inch of water and preferably between one-half inch and one inch of water for reliable paper handling. The vacuum developed by the vacuum generator 60 is directed by the connecting member 64 to a directing member 66 attached thereto. The generator 60 is selected so that it delivers a high flow rate at the required pressure. Typically, flow rates of approximately five to thirty cubic feet per minute (CFM) are sufficient for steam removal.

The directing member 66 defines a first vacuum chamber with a bottom wall portion 68 of the vacuum plenum 62. The directing member 66 includes a top portion 70 connected to a first side portion 72 and a second side portion 74. The first cavity defined by the top portion 70, the first side portion 72, the second side portion 74, and the bottom wall portion 68 cooperate to initially receive the vacuum or negative pressure generated by the vacuum generator 60. Each of the top portion 70, the first side portion 72, and the second side portion 74 individually define differing areas of negative pressure within the vacuum plenum 62.

As illustrated in FIG. 3, the first side portion 72 defines a plurality of apertures 76 spaced along the first side portion 72. The apertures 76 direct the negative pressure generated by the vacuum generator 60 to a leading edge negative pressure chamber 78 defined by the first side portion 72, the plenum 62, and a baffle 80. The baffle 80 is attached to the common edge of the top portion 70 and the first side portion 72 and extends at an angle towards the top of the vacuum plenum 62 defining a slot 82 therewith. The slot 82 is substantially perpendicular to the process direction 30 and extends substantially the width of or greater than the width of the recording sheet 17. A leading edge negative pressure developed in the chamber 78 is directed by the slot 82 to the leading edge of the recording sheet 17 entering the dryer for acquiring the leading edge thereof for transport through the microwave dryer 26.

The top portion 70 defines a second plurality of apertures 84 for directing the negative pressure developed within the directing member 66 to an area 86 located directly above the top portion 70.

The second side portion 74 includes a third plurality of apertures 88 for directing the negative pressure generated by the vacuum generator 60 into a third area 90 located within the vacuum plenum 62.

In the embodiment of FIG. 3, the plurality of third apertures 88 are sized differently than the apertures of the second plurality 84 which, in turn, are sized differently than the first plurality of apertures 76. Consequently, the amount of negative pressure present in the first area 78, the second area 86, and the third area 90, is thereby controlled to be different with respect to one another. In this way, the vacuum plenum 62 delivers non-uniform pressure along the process direction 30, with maximum pressure developed in the first area 78 for lead edge acquisition of the recording sheet 17. In general, the apertures of the plurality of third apertures 88 are smaller than the apertures of the second plurality 84 which are smaller than the apertures of the first plurality 76.

The aperture size within each of the first plurality of apertures 76, the second plurality of apertures 84, and the third plurality of apertures 88, are also sized such that uniform pressure is delivered across the width of the paper. Uniform pressure is developed along the width of the paper by forming the apertures of each of the plurality of apertures 76, 84 and 88 such that the apertures within one of the plurality of apertures increase in size as the distance of the aperture from the vacuum source increases. Because changes in aperture size occur within a single plurality of apertures, the size of one aperture in one plurality may be the same size as an aperture of another plurality although apertures of the same size within different plurality of apertures are typically spaced from the vacuum source by a different distance. For instance, as can be seen for the apertures of the third plurality of apertures 88 located in the second side portion 74, the aperture 88A located closest to the vacuum generator 60 is slightly smaller than the aperture 88B adjacent thereto. The aperture 88C is slightly bigger than the aperture 88B which is closer to the vacuum generator 60 than the aperture 88C. Finally, the aperture 88D is the largest of all of the third plurality of apertures 88. This pattern of aperture size increasing the further an aperture is located from the vacuum generator 60 is also followed for the second plurality of apertures 84 and the first plurality of apertures 76. The increasing size of the apertures within a single plurality of apertures provides the uniform pressure developed across the width of a recording sheet 17.

Not only is the present invention directed to holding the recording sheet 17 to the belt 12, the present invention also helps to reduce or prevent the "dryer rain" problem which occurs within the dryer 26. To remove the evaporated liquid which is driven off from the ink during drying, the vacuum generator 60, due to its generation of a negative pressure, exhausts the evaporated liquid from the microwave dryer 26 out the exhaust member 61 to either atmosphere or to a collection apparatus for the evaporated liquid. This liquid is removed when the plenum is not completely covered by a recording sheet or is subject to inter-document gaps.

Figure 4:
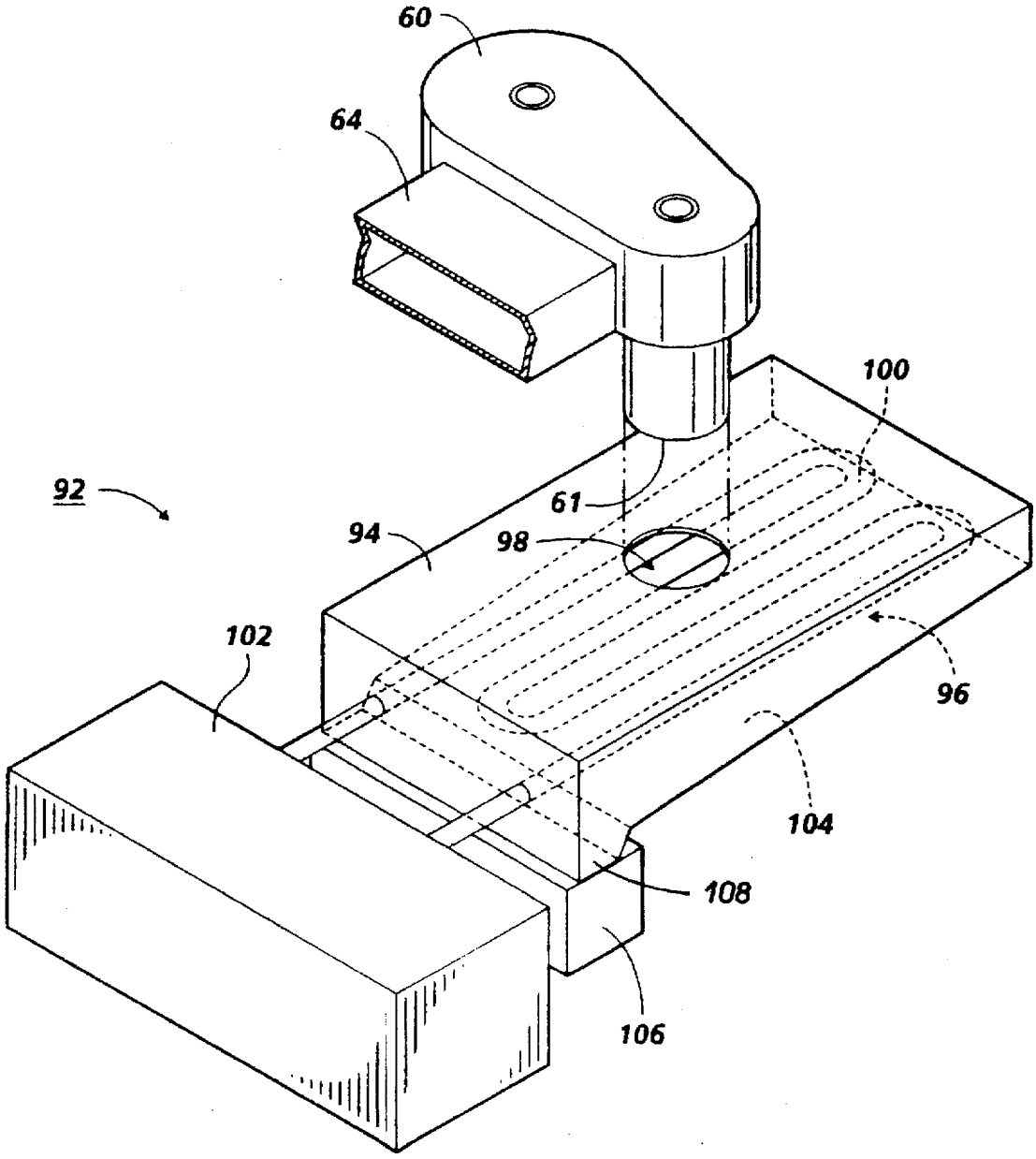
FIG. 4 is a perspective cutaway view of a collection device of the present invention.

FIG. 4 illustrates a collection apparatus 92 which includes a housing 94 defining a condensation cavity 96 in which the moisture removed from the dryer 26 condenses. The exhaust member 61 is connected to an input portion 98 which receives the moisture or solvent laden air withdrawn from the dryer. A condensation coil 100, for condensing the moisture, is disposed in the housing 94 and carries a cooling fluid which is circulated by a cooling fluid circulation pump 102 connected to the condensation coil 100.

While the use of a condensation coil speeds up the rate of condensation, the condensation coil is not necessary and the collecting apparatus 92 may operate without one and rely solely on dew point for condensation.

The condensed liquid falls to a bottom portion 104 which is angled slightly with respect to horizontal to cause the liquid to flow in a collection receptacle 106 attached to an exit portion 108 of the collection housing 94 where it can be emptied periodically by the user.

Figure 5:
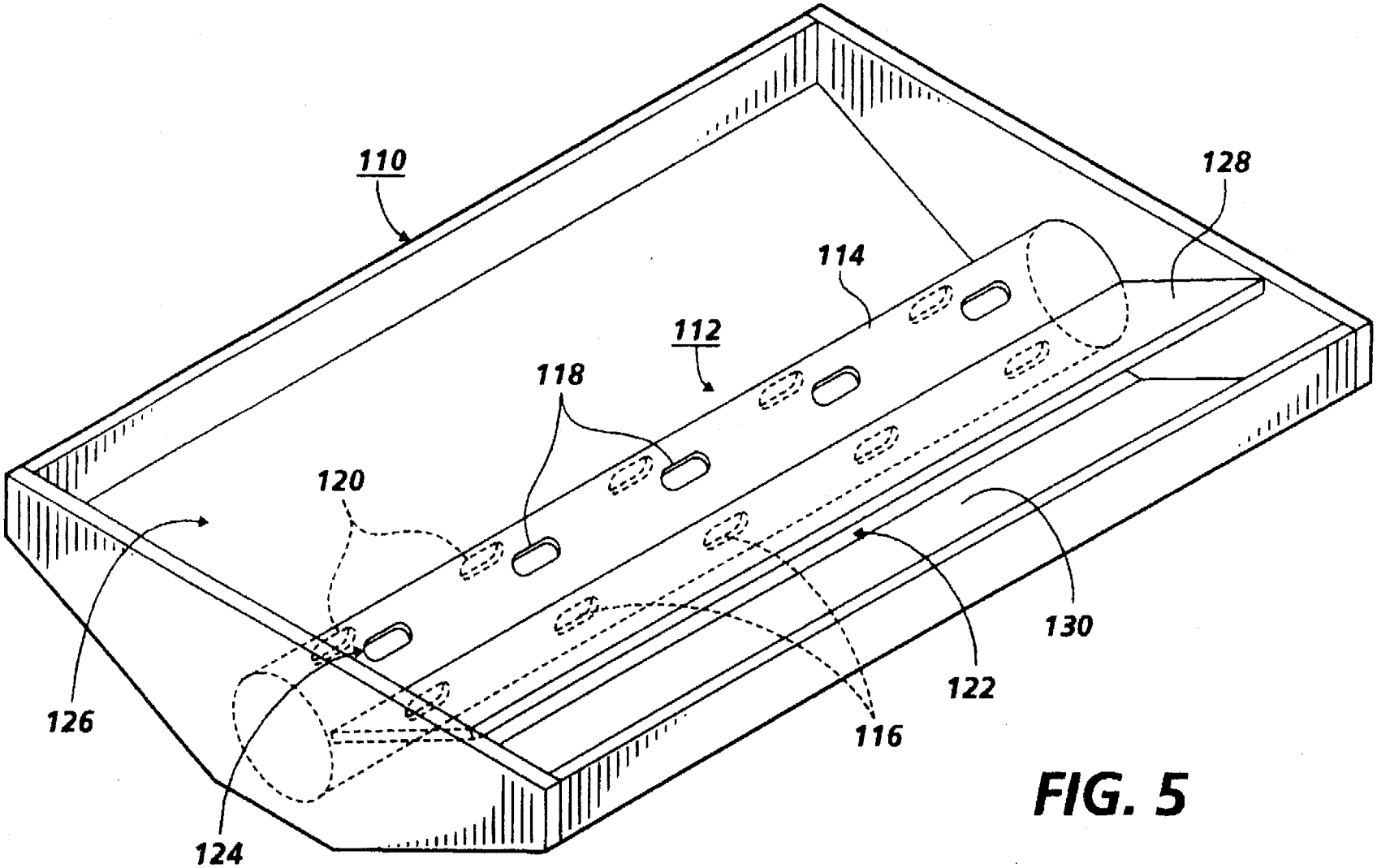
FIG. 5 is a second embodiment of a pressure member defining a negative pressure chamber for directing an applied vacuum to a transport belt for holding a recording sheet thereto.

FIG. 5 illustrates a second embodiment of the pressure member which defines a negative pressure chamber for directing an applied vacuum to a transport belt for holding a recording sheet thereto. The negative pressure member includes a vacuum plenum 110 which is connected to a vacuum generator (not shown) through a connecting member (not shown) as previously described in FIG. 3. The vacuum generating member generates a vacuum which creates a negative pressure within the plenum 110 as previously described. The vacuum developed by the vacuum generator is directed by the connecting member to a directing member 112 which includes a tube 114 disposed towards the bottom interior of the plenum 110. The tube 114 includes a first plurality of apertures 116, a second plurality of apertures 118, and a third plurality of apertures 120 each functioning to define a first negative pressure area 122, a second negative pressure area 124 and a third negative pressure area 126. The first negative pressure area 122 is directed to the entrance of the dryer and to the leading edge of the recording medium 17 by a baffle 128 attached to the tube 114 at a portion of the tube 114 located between the first plurality of apertures 116 and the second plurality of apertures 118. The baffle 128 extends at an angle away from the tube 114 and towards the top portion of the vacuum plenum 110 defining a slot therewith. A slot 130 is substantially perpendicular to the process direction 30 and extends substantially the width of or greater than the width of the recording sheet 17 as previously described for the embodiment of FIG. 3. A leading edge negative pressure developed in the first pressure area 122 is directed by the slot 130 to the leading edge of the recording sheet 17 for acquiring the leading edge thereof to insure adequate negative pressure under the leading edge of the recording sheet as it enters the dryer for transport through the microwave dryer 26.

The second plurality of apertures 118 and the third plurality of apertures 120 function as previously described in the embodiment of FIG. 3 to develop different areas of negative pressure within the plenum 110. Likewise, the size of each of the apertures within a plurality of apertures changes from the first plurality of apertures 116 to the second plurality of apertures 118 to the third plurality of apertures 120 as previously described. In this way, a non-uniform negative pressure is applied to the recording sheet during transport from the input portion 22 of the microwave dryer 26 to the output portion 24 thereof. The maximum negative pressure is developed at the input portion 22 by the first plurality of apertures 116, the baffle 128, and the interior area of the plenum 92.

In the previously described embodiments, moisture removal occurs in the interdocument region or when the plenum is not covered. In the case of continuous printing of many documents, however, the previous embodiments may be inadequate to remove a sufficient amount of the condensation collecting within the dryer. Consequently, it is also possible to attach an evacuation device 132 to another side of the dryer 26 as illustrated in FIG. 1. The evacuation device 132 defines a plenum located above the dryer 26, which would include a plurality of suitable apertures as illustrated in FIG. 7 of U.S. patent application Ser. No. 08/159,358. In this embodiment, however, the evacuation device is designed to apply a high flow rate and substantially no vacuum since the recording sheet must remain in contact with the belt 12. A suitable flow rate is approximately five to thirty CFM. In this configuration, steam is removed continuously.

The evacuation device 132 can include a generating member and plenum as previously described and illustrated in FIGS. 3 and 5. The baffle, is not, however, necessary since lead edge acquisition is not required. In addition, the spacing and shape of the apertures for the directing member can be modified to create a desired negative pressure within the plenum for removal of condensation.

It is, therefore, apparent that there has been provided in accordance with the present invention, a recording sheet transport and effluents removal system that fully satisfies the aims and advantages hereinbefore set forth. While this invention has been described in conjunction with a specific embodiment thereof, it is evident that many alternatives, modifications and variations will be apparent to those skilled in the art. For instance, the shape of the directing members is not limited to tubular or rectangular shapes but also includes structures having any number of sides or structures having surfaces other than circular, such as elliptical. Likewise, the shape of the plenum is not limited to the shapes illustrated in FIG. 3 and FIG. 5 but can include other shapes defining an interior cavity for the direction of a vacuum to the recording medium. Accordingly, it is intended to embrace all such alternatives, modifications and variations that fall within the spirit and broad scope of the appended claims.

What is claimed is:

1. An ink jet printer for depositing liquid ink on a recording medium, comprising:

a microwave dryer, including a portion having a plurality of apertures of a size to impede microwave leakage therefrom, for evaporating liquid from the liquid ink deposited on the recording medium;

a transport belt, associated with said microwave dryer, for moving the recording sheet through said microwave dryer; and an evacuation device, including a vacuum generator for developing a negative pressure, operatively coupled to said portion of said microwave dryer, for removing the evaporated liquid from said dryer through said plurality of apertures.

2. The ink jet printer of claim 1, wherein said evacuation device include an evacuation chamber associated with said microwave dryer, said evacuation device decreasing the pressure in said evacuation chamber to reliably secure the recording medium to said transport belt during movement through said microwave dryer.

3. The ink jet printer of claim 2, wherein said evacuation device includes a directing member disposed in said evacuation chamber, said directing members applying a nonuniform negative pressure on the recording sheet medium during movement through said microwave dryer.

4. The ink jet printer of claim 3, wherein said directing member applies a negative pressure to acquire a leading edge of the recording sheet as the recording medium enters said microwave dryer.

5. The ink jet printer of claim 4, wherein said directing member includes a plurality of apertures, having areas of different negative pressures within the evacuation chamber.

6. The ink jet printer of claim 5, wherein said directing member comprises a baffle, said baffle applying one of the plurality of areas of negative pressure on the recording medium as the recording medium enters said microwave dryer.

7. The ink jet printer of claim 6, wherein said directing member includes the plurality of apertures as being arranged in a plurality of rows.

8. The ink jet printer of claim 7, wherein the apertures of one of said plurality of rows includes first apertures of a first size.

9. The ink jet printer of claim 8, wherein the apertures of another of said plurality of rows includes second apertures of a second size different than the size of the first apertures.

10. The ink jet printer of claim 7, wherein the apertures of one of said plurality of rows includes apertures of varied sizes.

11. The ink jet printer of claim 10, wherein said evacuation device includes a vacuum generator, coupled to said directing member for developing a negative pressure.

12. The ink jet printer of claim 11, wherein said directing member comprises a tube.

13. The ink jet printer of claim 2, wherein said evacuation device develops a negative pressure of greater than one-quarter inch of water.

14. The ink jet printer of claim 13, wherein said evacuation device develops a negative pressure ranging from approximately one-half inch and to approximately one inch of water.

15. The ink jet printer of claim 1, wherein said evacuation device comprises a collection member for collecting the evaporated liquid.

16. The ink jet printer of claim 15, wherein said collection member comprises a condenser coil.

* * * * *